US011303085B2

(12) United States Patent
Thompson

(10) Patent No.: US 11,303,085 B2
(45) Date of Patent: Apr. 12, 2022

(54) FOLDABLE PLUG ASSEMBLY

(71) Applicant: BAE Systems plc, London (GB)

(72) Inventor: Gregory Warren Thompson, Preston (GB)

(73) Assignee: BAE Systems plc, London (GB)

( * ) Notice: Subject to any disclaimer, the term of this patent is extended or adjusted under 35 U.S.C. 154(b) by 0 days.

(21) Appl. No.: 17/140,332

(22) Filed: Jan. 4, 2021

(65) Prior Publication Data

US 2021/0126417 A1 Apr. 29, 2021

Related U.S. Application Data

(63) Continuation of application No. 16/651,708, filed as application No. PCT/GB2018/052871 on Oct. 8, 2018, now Pat. No. 10,910,784.

(30) Foreign Application Priority Data

Oct. 9, 2017 (EP) ..... 17195531
Oct. 9, 2017 (GB) ..... 1716514

(51) Int. Cl.

| | |
|---|---|
| ***H01R 43/20*** | (2006.01) |
| ***H01R 13/424*** | (2006.01) |
| ***H01R 13/50*** | (2006.01) |
| ***H01R 13/514*** | (2006.01) |

(52) U.S. Cl.
CPC ..... *H01R 43/20* (2013.01); *H01R 13/424* (2013.01); *H01R 13/501* (2013.01); *H01R 13/514* (2013.01)

(58) Field of Classification Search
CPC .. H01R 13/424; H01R 13/514; H01R 13/506; H01R 13/501; H01R 13/5045; H01R 43/20
USPC ..... 439/712–715, 731, 540.1
See application file for complete search history.

(56) References Cited

U.S. PATENT DOCUMENTS

| | | | | |
|---|---|---|---|---|
| 3,824,681 | A | 7/1974 | Clark | |
| 4,872,855 | A | 10/1989 | Norden | |
| 4,997,396 | A | 3/1991 | Gold | |
| 5,190,482 | A | 3/1993 | VanDerStuyf | |
| 5,643,009 | A | 7/1997 | Dinkel | |
| 8,353,724 | B2 | 1/2013 | Shi | |
| 9,431,732 | B1 * | 8/2016 | Baldwin | H01R 13/5829 |
| 9,660,394 | B2 | 5/2017 | Zien | |
| 2005/0164548 | A1 | 7/2005 | Spears | |

(Continued)

FOREIGN PATENT DOCUMENTS

| | | | |
|---|---|---|---|
| DE | 3114099 | A1 | 10/1982 |
| DE | 29911856 | U | 9/1999 |

(Continued)

OTHER PUBLICATIONS

International Search Report and Written Opinion for PCT Appl. No. PCT/GB2018/052871, dated Dec. 19, 2018, 13 pages.

(Continued)

*Primary Examiner* — Abdullah A Riyami
(74) *Attorney, Agent, or Firm* — Maine Cernota & Rardin

(57) ABSTRACT

A plug assembly in which the insulator part can be moved from an unfolded state to a folded state. The insulator may be utilised in the unfolded state for assembly of a wiring loom and then folded into the folded state for insertion into a connector body.

15 Claims, 3 Drawing Sheets

(56) References Cited

U.S. PATENT DOCUMENTS

| | | | |
|---|---|---|---|
| 2005/0282434 | A1 | 12/2005 | Morikawa |
| 2008/0242144 | A1 | 10/2008 | Dietz |
| 2010/0216353 | A1 | 8/2010 | Wellman |
| 2011/0294342 | A1 | 12/2011 | Debock |
| 2015/0229067 | A1 | 8/2015 | Nakai |

FOREIGN PATENT DOCUMENTS

| | | | |
|---|---|---|---|
| DE | 19931728 | A1 | 1/2001 |
| DE | 20207074 | U | 9/2003 |
| EP | 0847107 | A1 | 6/1998 |
| EP | 2985840 | A1 | 2/2016 |
| EP | 3208893 | A2 | 8/2017 |
| WO | 2011055443 | A1 | 3/2013 |

OTHER PUBLICATIONS

Search Report for Great Britain Patent Appl. No. GB1716514.3, dated Mar. 16, 2018, 4 pages.
Extended European Search Report for European Patent Appl. No. 17195531.3, dated Nov. 6, 2017, 9 pages.
International Preliminary Report on Patentability of PCT Appl. No. PCT/GB2018/052871, dated Apr. 23, 2020, 9 pages.
Office Action for U.S. Appl. No. 16/651,708, dated Jun. 10, 2020, 15 Pages.
Non Patent Literature, English translation for European Patent No. 0847107, 5 Pages.
Non Patent Literature, English translation for PCT Appl. No. 2011055443, 6 Pages.
Notice of Allowance for U.S. Appl. No. 16/651,708, dated Sep. 29, 2020, 13 Pages.

* cited by examiner

FOLDABLE PLUG ASSEMBLY

RELATED APPLICATIONS

This application is a continuation of U.S. patent application Ser. No. 16/651,708, which is a national phase application filed under 35 USC § 371 of PCT Application No. PCT/GB2018/052871 with an International filing date of Oct. 8, 2018, which claims priority of GB Patent Application 1716514.3 filed Oct. 9, 2017 and EP Patent Application 17195531.3 filed Oct. 9, 2017. Each of these applications is herein incorporated by reference in its entirety for all purposes.

FIELD OF THE INVENTION

This disclosure relates to electrical plugs and sockets, and in particular insulator systems for electrical plugs.

BACKGROUND OF THE INVENTION

FIG. 1 shows a schematic diagram of a typical electrical plug system with a partial cut-away cross section and having multiple pins. The plug system comprises a plug part 10 which fits into a socket part 11 such that electrical contact is made between pins 12, 13 in each of those parts. Each of the plug 10 and socket 11 part comprises a housing 14, 15 and an insulator 16, 17.

In the example of FIG. 1 socket part 11 is for mounting in a panel and holds male pins 13. The back side 18 of the socket is exposed at the rear of the panel and wires are connected to the pins 13 on this side. The plug 10 is open at its rear side 19 for the entry of wires connected to pins 12.

In order to assemble the plug and socket on the end of respective bundles of wires each of the pins 12, 13 is attached to the end of a wire in the bundle, and the pin is inserted from the rear face of the plug/socket 10, 11 into the insulator 16, 17 where it is retained. This assembly is a manual labour-intensive process as each wire & pin must be identified and inserted into the correct receiving hole in the relevant insulator 16, 17. Insertion of wires into the correct holes is a manual task due to the small area in the connector back and difficulties of alignment.

Typically plugs and sockets such as those shown in FIG. 1 are utilised to connect sections of wiring looms for vehicles such as aircraft. Such wiring looms often comprise large numbers of wires and connectors with different routing for different wires. Such looms are assembled in 2D on wiring layout boards where wires are cut to length and bound together in the required layout. The 2D assembly can then be removed from the layout board and the loom transferred to the vehicle.

A difficulty occurs because it is often necessary to route the loom through small spaces with holes that are too small for plugs and sockets to pass through. It is therefore necessary to assemble the loom without the plugs and sockets, position the loom in the required location, and then add the plugs and sockets. The difficult assembly of the connectors is thus made harder as it must be performed in the imperfect environment of the vehicle. Furthermore, to avoid damage to the pins it is often necessary to fit those after placement of the loom in the vehicle, rather than on the layout board.

Testing of the loom to ensure correct fitment of the connectors must then also be performed in-situ which is also difficult.

There is therefore a requirement for a connector system that offers improved assembly and testing.

Embodiments described below are not limited to implementations which solve any or all of the disadvantages of known systems.

SUMMARY OF THE INVENTION

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

There is provided a method of assembling a plug or socket of an electrical connector, the method comprising the steps of: providing an insulator in an unrolled state, the insulator comprising a plurality of segments, wherein the plurality of segments comprises a first segment and a last segment, the first and last segment being separated by at least one intermediate segment and wherein the intermediate segment is hingeably attached (e.g by way of a hinge) to the first segment and the last segment, and wherein at least one of the plurality of segments has at least one pin retaining means. The method further comprises attaching a pin to a respective wire, the pin being configured for retention by the at least one pin retaining means; inserting the pin into one of the at least one pin retaining means; rolling the insulator into a rolled state (by way of the plurality of hinges) so that the first segment and last segment engage, the rolled insulator being receivable by a housing of the plug or socket; and inserting the rolled insulator into the housing.

The at least one intermediate segment may be one intermediate section. Alternatively, the at least one intermediate segment comprises a plurality of intermediate sub-sections, the intermediate sub-sections being hingeably attached (e.g. by way of a plurality of hinges) to one another.

In the unrolled state the plurality of segments may present the pin retaining means adjacent to each other. They may be in substantially the same plane and may be in a linear array.

A plurality of wires may be attached to a plurality of pins and inserted into the insulator to form a wiring loom.

Between the steps of rolling the insulator and inserting the insulator in the housing, the wiring loom is installed.

The method may further involve performing a continuity check between the steps of inserting a pin into the insulator and folding the insulator. The method may further comprise connecting an earth material to at least one of the wires.

The step of inserting the pin into the insulator may be automated.

The insulator may be movable between the unrolled and rolled state by rotating relative to each other about their point of connection, for example by bending a plurality of hinges. In other words, each segment/section is hingeably attached to one another so that when the first section is rolled towards the last section, the intermediate segment/sub-sections move relative to one another (and relative to the first and last segments) by way of the plurality of hinges.

There is also provided an insulator component for carrying electrical pins in a plug or socket of an electrical connector, the insulator component comprising: an insulator comprising a plurality of segments, wherein the plurality of segments comprises a first segment and a last segment, the first and last segment being separated by at least one intermediate segment; wherein the intermediate section is hingeably attached to the first segment and the last segment; and wherein at least one of the plurality of segments has at least one pin retaining means, the pin retaining pins configured for retention of at least one pin when attached to a respective wire. The plurality of segments are configured to be movable between an unrolled state and a rolled state so that the first segment and the last segment engage, and wherein the rolled state is configured to be received within a housing part of an electrical plug or socket.

The insulator component may further comprise means to retain the insulator in the folded state. For example, the first and last segments may be held to one another in the rolled state by way of a retaining means such as a clip or tape. Alternatively a separate retaining component may be utilised. The retaining means may be designed to be permanent or reversible.

The insulator component may further comprise machine-readable markings for the identification of segments and/or pin retaining means.

There is also provided a connector assembly comprising a connector housing and an insulator component as described herein.

There is also provided a plug or socket obtainable by the method of assembling a plug or socket of an electrical connector described herein.

There is provided an insulator component for carrying electrical pins in a plug or socket of an electrical connector, the insulator comprising a plurality of segments, one or more of the segments having pin retaining means for retaining at least one electrical pin, wherein the segments are movable between an unfolded state and a folded state, wherein the folded state is configured to be received within a housing part of an electrical plug or socket.

In the unfolded state segments may be arranged to allow easy insertion of pins into the pin retaining means.

In the unfolded state segments may be arranged to present the pin retaining means in a linear array.

At least one segment may be connected to at least one other segment by a hinge.

The insulator may be movable between the unfolded and folded state by bending each hinge.

The insulator may further comprise means to retain the insulator in the folded state.

The retaining means may allow insertion of a pin through a side surface of the insulator.

The insulator may further comprise machine-readable markings for the identification of segments and/or pin retaining means.

There is also provided a connector assembly comprising a connector housing and an insulator component as described hereinbefore.

There is also provided a method of assembling a plug or socket of an electrical connector, the method comprising the steps of providing an insulator component in an unfolded state, the insulator comprising a plurality of segments, at least one segment having at least one pin retaining means; attaching a pin to a respective wire, the pin being configuring for retention by the at least one pin retaining means; inserting the pin into one of the at least one pin retaining means; folding the insulator component into a folded state in which it is receivable by a housing of the plug or socket; and inserting the folded insulator component into the housing.

A plurality of wires may be attached to a plurality of pins and inserted into the insulator component to form a wiring loom.

Between the steps of folding the insulator and inserting the insulator in the housing the wiring loom may be installed.

The method may further comprise performing a continuity check between the steps of inserting a pin into the insulator component and folding the insulator.

The step of inserting the pin into the insulator may be automated.

An earth material may be connected to at least one of the wires.

BRIEF DESCRIPTION OF THE DRAWINGS

Embodiments of the invention will be described, by way of example, with reference to the following drawings, in which.

DETAILED DESCRIPTION

Figure 1:
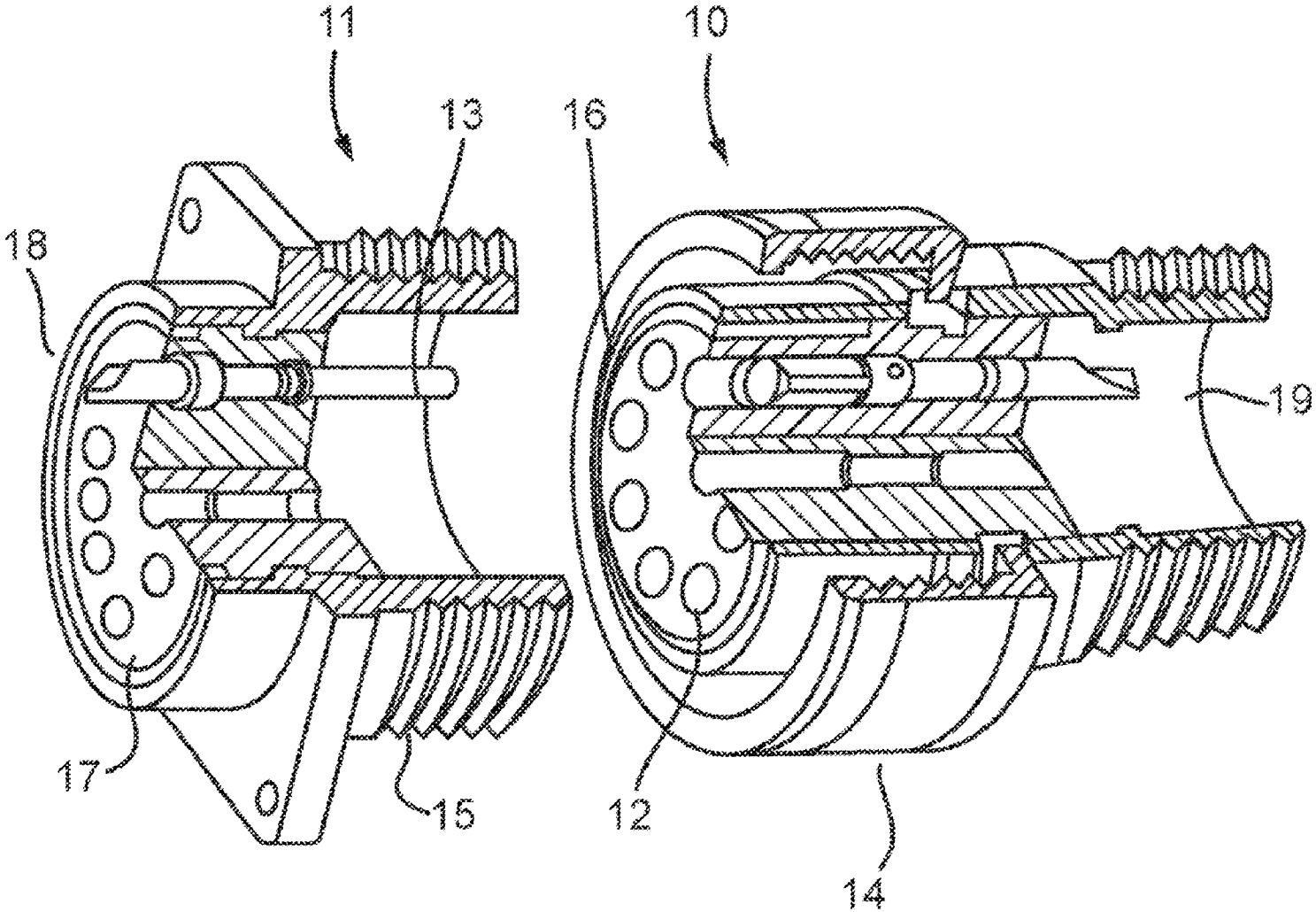
Figure 1 (PRIOR ART)
FIG. 1 shows a conventional plug and socket.

Further details, aspects and embodiments of the invention will now be described, by way of example only, with reference to the drawings. Elements in the figures are illustrated for simplicity and clarity and have not necessarily been drawn to scale. Like reference numerals have been included in the respective drawings to ease understanding.

The current disclosure describes a new design of insulator component for holding pins in plugs and sockets which offers improved assembly and testing compared to the prior art. The insulator is provided in an unfolded (unrolled) state in which pins can be easily inserted and connections verified. After insertion of all pins, the insulator is folded (rolled) into the state required for insertion into the connector body. In the folded state the insulator is significantly smaller than the connector body and can thus be fed through small spaces during installation of the wiring loom prior to insertion in the connector body. The pins and insulator can thus be assembled with the loom during manufacture of the loom on the layout board thus giving a more convenient manufacturing location. In the unrolled state, the insulator is essentially flat, thus enabling easier wire pin installation and inspection.

In an example, the unfolded insulator may present the pin locations in a linear array (that is, with the pin locations lying in a single plane and along a single axis such that the pins are generally parallel to one another). The position of each pin is thus readily apparent to a user. This simplifies the correct matching of wires to pin locations compared to a conventional plug or socket where locations must be identified through the rear of the housing. Correct fitment of pins into the insulator is thus simplified. Furthermore, verification of correct matching is also simpler as a visual inspection readily shows which wire is connected at which location. For example, the unfolded insulator may present the pin locations in a linear array, numbered sequentially. Sequentially numbered wires can then match the location numbers. Other location layouts may also be provided for convenient assembly. The open, flat nature of the unrolled/unfolded design enables automation techniques to be applied for example robot pin installation and inspection.

Once the wiring loom is positioned in the required location the insulator is inserted into the relevant connector body and assembly is complete. Since this final step does not define the location or electrical connections of wires within the connector verification at this stage may be minimised.

Figure 2A:
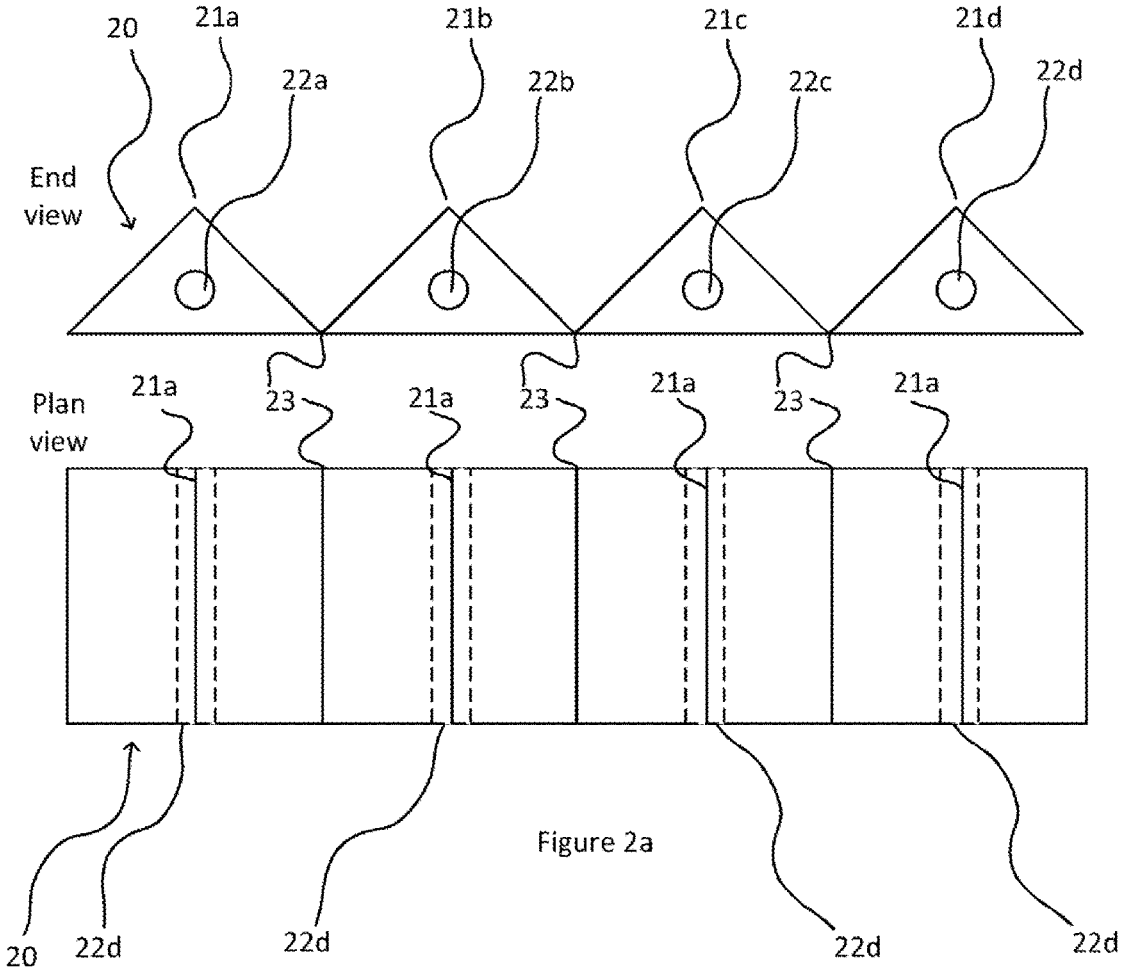
FIGS. 2A, 2B, and 2C show an insulator component according to the current disclosure.
Figure 2B:
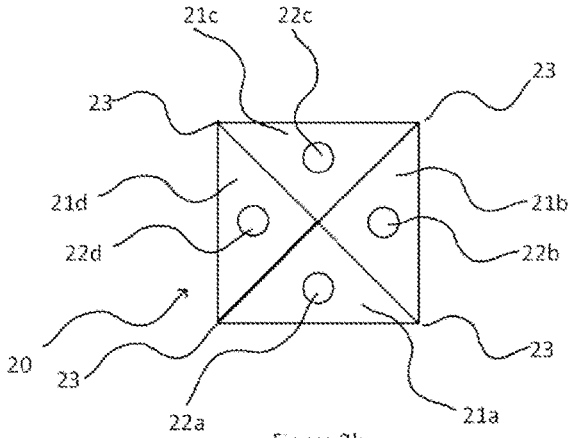
Figure 2C:
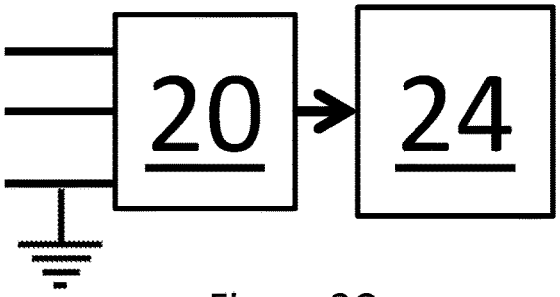

FIGS. 2A and 2B show a schematic diagram of an example insulator according to the current disclosure. FIG. 2*a* shows end and plan views in the unfolded state, FIG. 2*b* shows an end view in the folded state, and FIG. 2*c* shows a side elevation view of the example insulator being inserted into a housing 24, which is also herein referred to as a connector body 24.

The insulator 20 comprises four segments 21*a-d*, each formed as a triangle shape. Each segment comprises a pin retaining means 22*a-d* for receiving and retaining a pin. The segments 21*a-d* are connected such that they can be rotated relative to each other about their point of connection and folded or rolled up to form the folded state shown in FIG. 2*b*. The connector body is configured to receive and retain the insulator in the folded state using configurations known in the art. A means to retain the insulator in the folded state may be provided, for example clips or tape may be provided to retain each segment in location. Alternatively a separate retaining component may be utilised. The retaining means may be designed to be permanent or reversible.

The example of FIGS. 2A and 2B is only one example of an insulator design in accordance with the current disclosure for use in an electrical connector, for example a plug or socket. The number of pin retaining means in each segment may be varied and the number of segments may be varied. For example there may be 1 to 5 pin retaining means, for example 1, 2, 3, 4 or 5 pin retaining means. There may also be from 3 to 20 segments, or 3 to 10 segments, for example, 3, 4, 5, 6, 7, 8, 9, or 10 segments. The shape of the folded insulator may be selected as desired for a particular connector arrangement, for example, it may be triangular, rectangular or semi-circular. The shape and number of segments may be selected as appropriate to give the desired shape.

The folding mechanism may also be varied to provide the required unfolded and folded shape. For example a concertina structure may be utilised, or folding hinges 23 as shown in the example of FIGS. 2A and 2B. The terms folded and unfolded should not therefore be read to limit the insulator design to only those in which a purely folding mechanism is used.

The insulator may not fold to provide a solid shape, but may leave voids which may or may not be filled with other pieces of insulator material. For example the folding insulator with pins may form a circle which may be wrapped around a cylindrical central insulator. The central insulator may, or may not, have further pin retaining means and may, or may not, be connected to the other segments.

Any convenient arrangement of pin retaining means may be used which can receive and retain pins. In the example of FIGS. 2A and 2B, conventional through-holes from a rear face to a front face are provided. In an alternative arrangement, slots may be provided on a side face (i.e. a face orthogonal to the front and back faces) of the segments, for example the face which will be uppermost (which may be termed a top face) when the unfolded insulator is positioned on a surface for pins to be inserted. Any appropriate means for receiving and retaining pins may be utilised.

The insulator may be formed from any appropriate insulating material, for example a plastic such as polyvinylchloride, polyethylene, silicone, cross-linked polyethylene, polyurethane or a rubber.

Figure 3:
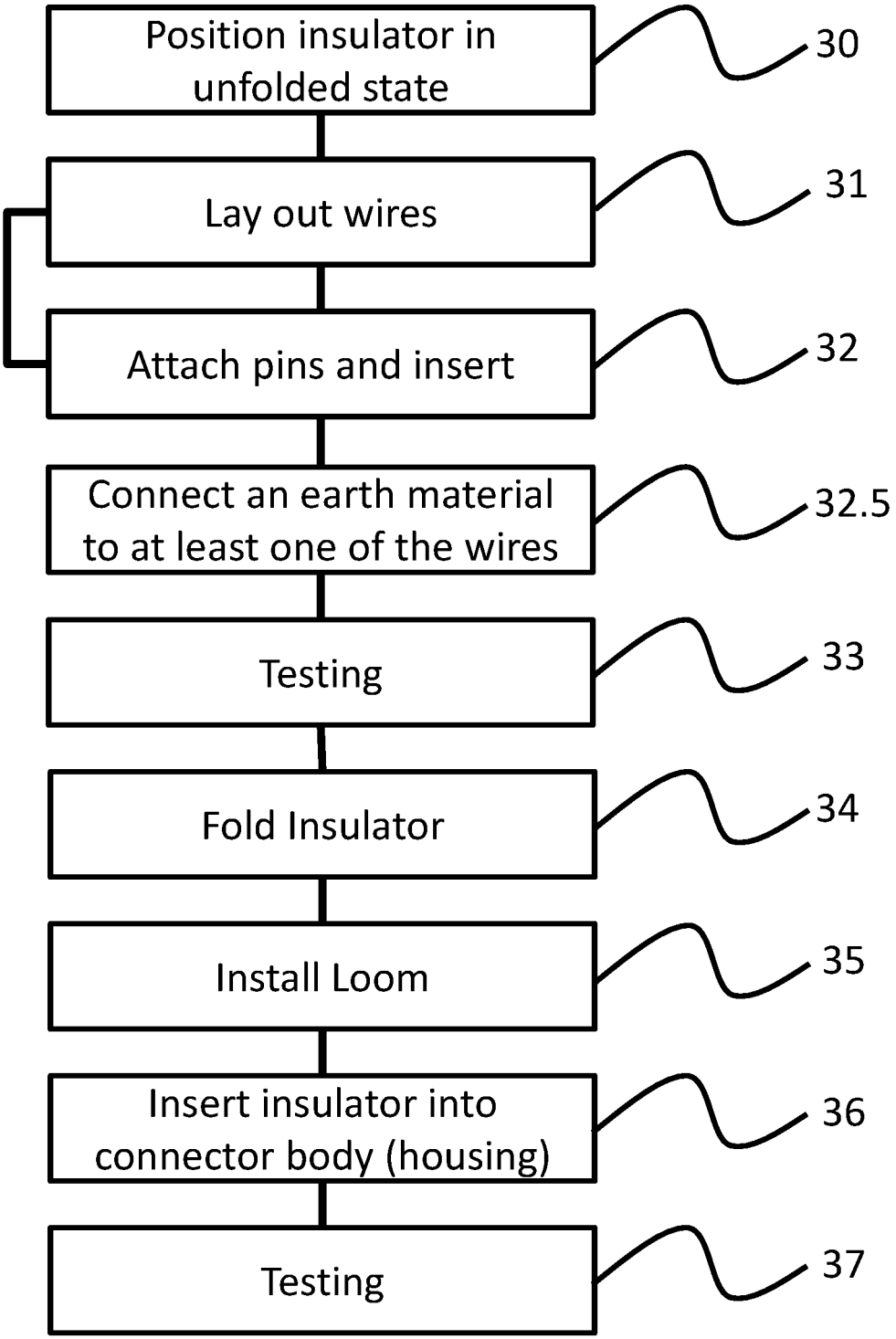
FIG. 3 shows a method for assembling an electrical connector.

FIG. 3 shows a method of assembly using an insulator of the type shown in FIGS. 2A and 2B. At step 30, an insulator in the unfolded state is positioned on a wiring layout board. At step 31, wires are laid out using the layout board in the required design. At step 32, pins are attached to the wires and the pins are inserted into the required location in the insulator. Steps 31 and 32 may be performed sequentially, or may be performed in turn for each wire. That is, all wires may be laid out, then all pins attached and inserted, or individual wires (or groups of wires) may be laid out, a pin attached and inserted into the insulator, and then the process repeated for other wires. These processes may be automated, by a suitable robot, due to the improved identification of, and access to, the pin retaining means. The segments and/or pin locations may be marked with machine- or human-readable identifiers to facilitate correct assembly.

At step 33 any required verification testing is performed. For example, visual and continuity testing may be conducted. Such testing may also be simpler than in previous designs due to the layout of the insulator and pin arrangement in the unfolded state.

At step 34 the insulator is folded or otherwise converted into the folded state and may be secured in that position using means provided on the insulator, for example sticky tape, or a separate temporary or permanent retaining means, for example a clip.

At step 35 the loom is installed in the required location, for example on a vehicle such as an aircraft, and at step 36 the insulators are inserted into respective connector bodies.

At step 37 any further testing is performed, but this may be minimal due to the earlier verification of correct wire and pin installation in the insulators.

In one embodiment of the method of FIG. 3, an additional step is performed to earth a selection of the pins/wires. Prior to step 33, in step 32.5, an earth material (for example a metal mesh) is electrically connected to wires which require an earth connection. This may be performed in the conventional manner, but, due to the easier-to-access layout, as described above, the process is easier to perform. In such embodiments, the earth material is rolled with the insulator and wires upon assembly and connected to an earth location in the conventional manner. This embodiment is also graphically depicted in FIG. 2C.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term 'comprising' does not exclude the presence of other elements or steps.

Furthermore, the order of features in the claims does not imply any specific order in which the features must be performed and in particular the order of individual steps in a method claim does not imply that the steps must be performed in this order. Rather, the steps may be performed in any suitable order. In addition, singular references do not exclude a plurality. Thus, references to 'a', 'an', 'first', 'second', etc. do not preclude a plurality. In the claims, the term 'comprising' or "including" does not exclude the presence of other elements.

What is claimed is:

1. A method of assembling a plug or socket of an electrical connector, the method comprising the steps of:

providing an insulator in an unrolled state, the insulator comprising a plurality of segments, wherein;

the plurality of segments comprises a first segment and a last segment, the first and last segment being separated by at least one intermediate segment and wherein the intermediate segment is hingeably attached to the first segment and the last segment, and wherein at least one of the plurality of segments has at least one pin retaining means;

attaching a pin to a respective wire, the pin being configured for retention by the at least one pin retaining means;

inserting the pin into one of the at least one pin retaining means;

rolling the insulator into a rolled state so that the first segment and last segment engage, the rolled insulator being receivable by a housing of the plug or socket; and inserting the rolled insulator into the housing.

2. The method according to claim 1, wherein the at least one intermediate segment is one intermediate section.

3. The method according to claim 1, wherein the at least one intermediate segment comprises a plurality of intermediate sub-sections, the intermediate sub-sections being hingeably attached to one another.

4. The method according to claim 1, wherein in the unrolled state the plurality of segments present the pin retaining means adjacent to each other in substantially the same plane in a linear array.

5. The method according to claim 1, wherein a plurality of wires are attached to a plurality of pins and inserted into the insulator to form a wiring loom.

6. The method according to claim 5, wherein between the steps of rolling the insulator and inserting the insulator in the housing the wiring loom is installed.

7. The method according to claim 5, further comprising connecting an earth material to at least one of the wires.

8. The method according to claim 1, wherein the step of inserting the pin into the insulator is automated.

9. The method according to claim 1, further comprising performing a continuity check between the steps of inserting a pin into the insulator and folding the insulator.

10. The method according to claim 1, wherein the insulator is movable between the unrolled and rolled state by bending a plurality of hinges.

11. An insulator component for carrying electrical pins in a plug or socket of an electrical connector, the insulator component comprising:

an insulator comprising a plurality of segments, wherein the plurality of segments comprise a first segment and a last segment, the first and last segment being separated by at least one intermediate segment, wherein the intermediate section is hingeably attached to the first segment and the last segment, wherein at least one of the plurality of segments has at least one pin retaining means, the pin retaining means being configured for retention of at least one pin when attached to a respective wire, and wherein the plurality of segments are configured to be movable between an unrolled state and a rolled state so that the first segment and the last segment engage, wherein the rolled state is configured to be received within a housing part of an electrical plug or socket.

12. The insulator component according to claim 11, further comprising means to retain the insulator in the folded state.

13. The insulator component according to claim 11, further comprising machine-readable markings for the identification of segments and/or pin retaining means.

14. A connector assembly comprising a connector housing and an insulator component according to claim 11.

15. A plug or socket obtainable by the method of assembling a plug or socket of an electrical connector of claim 1.

* * * * *